US006609943B1

(12) United States Patent
Chan

(10) Patent No.: US 6,609,943 B1
(45) Date of Patent: Aug. 26, 2003

(54) ELECTRONIC TALKING TOY AND DOLL COMBINATION

(75) Inventor: Albert Wai Tai Chan, Taipei (TW)

(73) Assignee: Thinking Technology, Inc., Nassau (BS)

( * ) Notice: Subject to any disclaimer, the term of this patent is extended or adjusted under 35 U.S.C. 154(b) by 0 days.

(21) Appl. No.: 10/062,509

(22) Filed: Feb. 5, 2002

(51) Int. Cl.[7] ..... A63H 3/28

(52) U.S. Cl. ..... 446/297; 446/275; 446/436; 446/465

(58) Field of Search ..... 446/484, 93, 297, 446/295, 296, 268, 275, 302, 397, 303, 431, 436, 438, 441, 457, 465, 470, 81, 175

(56) References Cited

U.S. PATENT DOCUMENTS 4,820,233 A * 4/1989 Weiner ..... 434/308
5,046,981 A * 9/1991 Roddy ..... 369/30.02
5,389,031 A * 2/1995 Sharpe et al. ..... 446/397
6,033,285 A * 3/2000 Fine et al. ..... 446/3
6,135,845 A * 10/2000 Klimpert et al. ..... 446/297

* cited by examiner

*Primary Examiner*—Derris H. Banks
*Assistant Examiner*—Bena B. Miller
(74) *Attorney, Agent, or Firm*—Kramer & Amado P.C.

(57) ABSTRACT

An electronic toy adapted to receive a toy figure comprises a source of electrical power, an integrated circuit chip programmed with pre-recorded sounds, sound reproduction means under the control of the integrated circuit chip, switch means adapted to open or close an electrical circuit to control the flow of electrical power from the source of electrical power to the integrated circuit and sound reproduction means, and trigger means adapted to activate the switch means, such that when the toy figure is placed into contact with the trigger means, the switch means is closed to create an electrical circuit and sounds are generated by the sound reproduction means under the control of the integrated circuit.

8 Claims, 7 Drawing Sheets

ELECTRONIC TALKING TOY AND DOLL COMBINATION

BACKGROUND TO THE INVENTION

It is a challenge to produce new and better toys which appear to work in mysterious ways and create magic for children. For some years, toys have been provided with simulated artificial speech capabilities. Initially, audio tapes or wires were used to produce a limited amount of simulated speech. With the advent of compact integrated circuit technology, it is now possible to program multiple sounds, including human speech, on integrated circuit chips small enough to be placed inside a toy. It is always possible to provide each doll or action figure with control buttons and switches in order to initiate simulated human speech or other sounds from that particular doll or action figure. It would be an advantage, however, to be able to place any one of multiple dolls or action figures in the same toy, create simulated human speech or other sounds, and avoid the cost of having to place expensive electronic components into each doll or action figure. It would be a further advantage if the initiation of simulated speech from the doll or action figure could be somewhat mysterious to the user.

SUMMARY OF THE INVENTION

Accordingly, in an aspect of the invention, an electronic toy adapted to receive a toy figure comprises a source of electrical power, an integrated circuit chip programmed with pre-recorded sounds, sound reproduction means under the control of the integrated circuit chip, switch means adapted to open or close an m electrical circuit to control the flow of electrical power from the source to the integrated circuit and sound production means, and trigger means adapted to activate the switch means, such that when the toy figure is placed into contact with the trigger means, the switch means is closed, electrical power flows, and sounds are created by the sound reproduction means under the control of the integrated circuit.

In further aspects of the invention:

(a) The electronic toy comprises a toy vehicle;

(b) The electronic toy comprises a toy vanity and seat;

(c) The electronic toy comprises a desk and chair;

(d) The toy figure comprises a doll;

(e) The toy figure comprises an action figure;

(f) The sound generation means comprises first and second sources of sound;

(g) The first source of sound is adapted to reproduce sounds appropriate to the toy figure;

(h) The simulated sounds comprise human speech;

(i) The second source of sound is adapted to reproduce sounds corresponding to the nature and operation of the electronic toy;

(j) The second source of sound is adapted to reproduce sounds corresponding to background noises for play activities;

(k) The second source of sound is adapted to reproduce musical sounds;

(l) The first source of sound is located proximate the toy figure when the toy figure is in contact with the trigger means;

(m) The second source of sound is located remotely from the toy figure when the toy figure is in contact with the trigger means;

(n) The electronic toy further comprises an electrical motor adapted to generate motion;

(o) A motion generating motor is controlled by an integrated circuit chip comprising pre-programmed motion instructions appropriate to the electronic toy;

(p) The motion is timed to correspond with generation of appropriate sounds;

(q) The toy is adapted to receive an accessory to trigger generation of sound segments from a source of sound appropriate to the accessory;

(r) The toy is provided with a pushbutton switch to trigger generation of sound segments;

(s) The toy is provided with a plurality of pushbutton switches, each dedicated to generation of specific sound segments.

In a particular embodiment of the invention, an electronic toy vehicle adapted to receive a doll comprises an electrical storage battery comprising a source of electrical power, an integrated circuit chip programmed with pre-recorded sounds, first and second audio speakers adapted to reproduce sounds based on signals from the integrated circuit chip, the first audio speaker being located proximate a vehicle seat adapted to receive the doll, and being dedicated to reproducing sounds corresponding to simulated speech of the doll, the second audio speaker being located remotely from the vehicle seat and being dedicated to reproducing sounds other than simulated speech of the doll, switch means adapted to open or close an electrical circuit to control the flow of electrical power from the source to the integrated circuit and the audio speakers, and trigger means adapted to activate the switch means, such that when the toy vehicle receives the doll, a portion of the doll contacts the trigger means to close the switch means and initiate production of sounds.

In a further particular embodiment of the invention, an electronic toy vehicle adapted to receive a doll comprises an electrical storage battery comprising a source of electrical power, an integrated circuit chip programmed with pre-recorded sounds, first and second audio speakers adapted to reproduce sounds based on signals from the integrated circuit chip, the first audio speaker being located remote from a vehicle seat adapted to receive the doll, and being dedicated to reproducing sounds corresponding to simulated speech of the doll, the second audio speaker being located proximate the vehicle seat and being dedicated to reproducing sounds other than simulated speech of the doll, switch means adapted to open or close an electrical circuit to control the flow of electrical power from the source to the integrated circuit and the audio speakers, and trigger means adapted to activate the switch means, such that when the toy vehicle receives the doll, a portion of the doll contacts the trigger means to close the switch means and initiate production of sounds.

Further aspects of the invention will be apparent from the following description.

BRIEF DESCRIPTION OF THE DRAWINGS

Illustrative embodiments of the invention are shown in the following drawings.

DETAILED DESCRIPTION OF THE INVENTION

The electronic toy adapted to receive a toy figure of the invention may be manifested in a variety of forms. For example, the toy may be a vehicle such as a car adapted to receive a doll or other action figure. In this embodiment, the doll appears to speak about activities relevant to riding in a car or destinations to be reached by car. Simulated cell phone conversations from the car, radio selection and music, background noises appropriate to the car driving through certain areas or to certain locations, and other sounds may all be reproduced. In addition, if motion is desired, by using electrical motors controlled by signals from integrated circuits and connected to appropriate mechanical parts, the toy vehicle can be made to vibrate, turn, or move backwards or forwards, for example. These motions can be programmed to correspond with sounds emanating from the speakers corresponding to either simulated speech of the doll or action figure, or to other sounds as described above. In addition, various lights can be made to go on and off under control of the integrated circuits.

Many other embodiments of the invention are also possible. For example, a desk and chair set could receive a doll, and the sounds and motions generated by the toy would be appropriate to some desk activity. Similarly, a makeup table or vanity could receive a variety of dolls and generate sounds and motions, or control lights, in an appropriate manner.

Other options are also possible. For example, the electronic toy could be a pet house and the toy figure could be a pet. In the case where the pet is a dog, a speaker located close to where the dog is placed can generate barking sounds or even simulated human speech if the dog is to have human-like characteristics. Similar principles could be applied to create simulated "speech" for other creatures.

Figure 4:
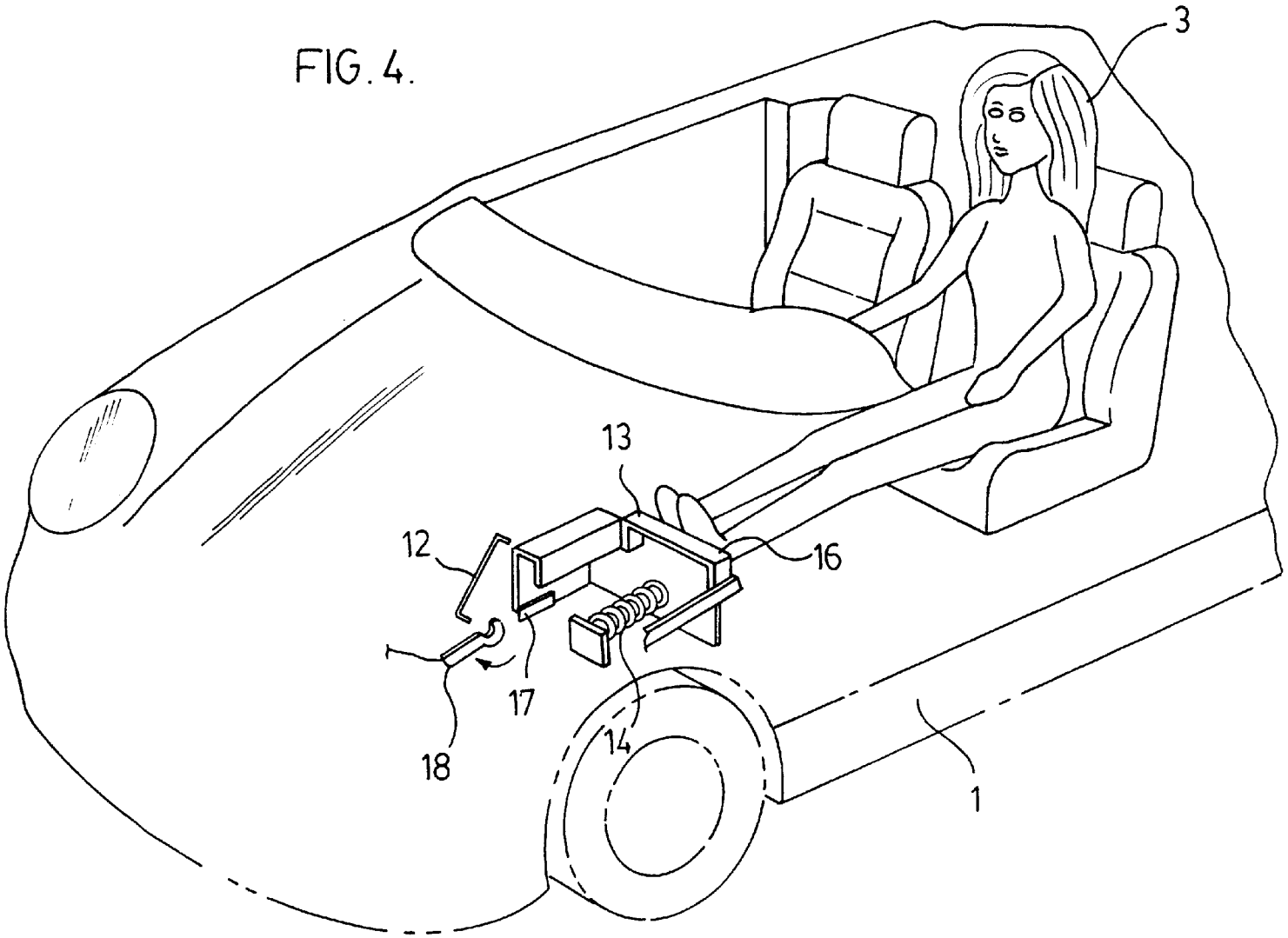
FIG. 4 is a schematic perspective view of the trigger mechanism to initiate activity of a vehicle and toy figure combination.

Referring to FIGS. 1 to 6, and the embodiments disclosed therein, a toy vehicle (1) comprises at least one seat (2) adapted to receive a doll or other toy figure (3) such as an action figure. In proximity to the seat (2) is located a first speaker (9A) adapted to reproduce sounds which appear to emanate from the doll or action figure (3) when the device is in operation. A second speaker (9B) is mounted somewhere on or in the vehicle remote from the first speaker (9A) so that sounds emanating from the second speaker (9B) do not appear to emanate from the toy figure. In certain cases the location of these speakers may be varied. For example, it may be that a speaker located near the front of the vehicle will be more appropriate for sounds supposedly generated by the toy figure, while a speaker located in the vicinity of the vehicle seat and controls to generate sounds perhaps including those of simulated radio, telephone and other accessories, or even engine sounds, will be more appropriate. In all cases, the principle is the same; speakers located at a distance from each other can generate sounds to give the impression that the sounds are emanating from different places. Hidden beneath the dashboard of the vehicle is a triggering mechanism (13). In the embodiment disclosed, the triggering mechanism (13) is spring-loaded and adapted to react under compression when the toy figure (3) is placed into the toy vehicle (1). The doll's knees or feet, or some other parts of the doll, can be used to press against a trigger plate in the trigger means (13) in order to place the spring into compression. If the trigger means are hidden from the user's view, and the toy appears to begin its activity merely because the doll or action figure has been placed into the toy, this will add to the mystery and "magic" of the toy. Referring to FIG. 4, when the spring (14) is compressed by movement of the trigger plate (16), the trigger means forces a first contact (17) of a switch (12) into engagement with a second contact (18) of the switch. This completes an electrical circuit allowing power to flow from one or more electrical storage batteries (5) located within the toy vehicle (1) in order to initiate activities of the toy.

Also located within the toy are one or more integrated circuit chips (8) and other ancillary electronic components. Pre-recorded on the integrated circuit chip or chips are a variety of "clips" of human speech which may be appropriate to various segments of conversation which the doll or action figure might utter when placed in the context of the toy vehicle. Signals from the integrated circuit chip (8) corresponding to such speech are routed to the first speaker (9A) located in vicinity of the seat of the vehicle, or otherwise located proximate the doll or action figure when it is placed in the vehicle, or in any suitable location on or in the vehicle. Thus, the sound can be made to appear to emanate from the doll or action figure rather than from somewhere else in the vehicle.

Other pre-recorded sounds, such as a running motor, traffic sounds, radio programming, cell-phone conversations, more distant overheard conversations or speech, or the sounds of a pet in the vehicle, are routed to one or more second speakers (9B) located on or in the vehicle at a distance remote enough from the first speaker so that these second sets of sounds do not appear to emanate from the doll or action figure. In such circumstances, the second speaker (9B) may be mounted in or near the dashboard of the vehicle to create the appropriate impression. It can also be mounted under or in the hood or near the wheels, or elsewhere as appropriate. Any suitable location is acceptable. Speaker openings (10A, 10B, 10C) are appropriately located in the vicinity of the speakers (9A, 9B) to produce the volume, location and quality of sound desired.

When the doll or action figure is removed from the car seat, a portion of the trigger means (13), such as the illustrated trigger plate (16), moves under the action of the spring (14), thus breaking the electrical contact at the switch (12) and ending, or initiating the ending, of the sound generation from the vehicle and other electrically-driven activities. Although certain sounds may continue to emanate from the vehicle after the doll or action figure is removed, it would be inappropriate for further sounds to come from the first speaker (9A) dedicated to toy figure sounds. This feature further contributes to maintaining the mystery and "magic" of the toy.

Figure 6:
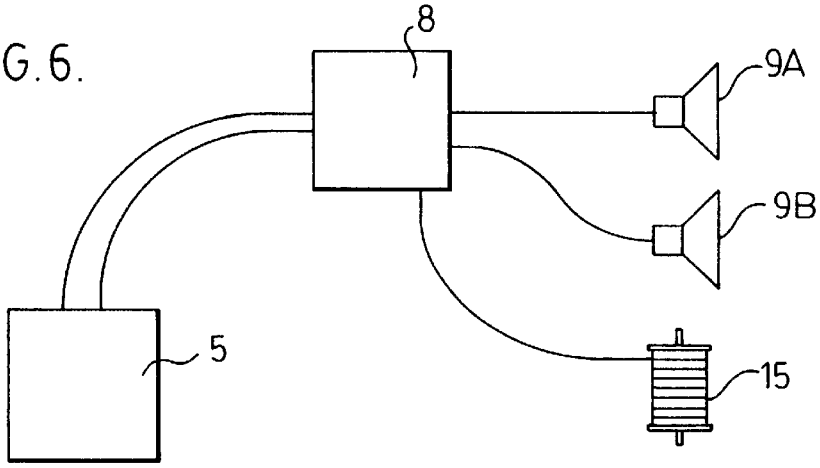
FIG. 6 is a schematic diagram of certain electronic and electrical components of an embodiment of the invention.

If desired, an electrical motor (15), shown schematically in FIG. 6, under the control of an integrated circuit chip, (8) can be connected to one or more moveable components (not shown) of the vehicle (1) in order to generate motion. Given the presence of one or more integrated circuit chips (8), such motion may be timed to correspond with the generation of sounds to enhance the effect. For example, vibration of the vehicle could be initiated when the engine sound is generated.

The enjoyment of a toy vehicle can be further enhanced by use of various additional components and accessories. For example, a seat-belt (6) can be provided. When the toy figure (3) is placed in the seat (2), the integrated circuit chip will be enabled to perform a number of features appropriate to having the toy figure present in the vehicle. Placing the toy figure in the vehicle may, for example, generate a sound segment apparently emanating from the toy figure requesting that the seat-belt be fastened. When the end portion of seat-belt (6) is placed in socket (7A) of the socket area (7), a further electrical switch (not shown) is tripped. The integrated circuit chip will then permit all of the accessories of the vehicle to operate. Initiation switch (33) generates a series of sound segments appearing to emanate from the toy figure or from other components of the car, such as the engine. As previously discussed, these sounds will be produced at the speakers (9A, 9B) located at a distance from each other to simulate sounds coming from different areas of the toy figure or the vehicle. Prior to placement of the toy figure in the vehicle, and the triggering of the switch (12), pressure on the initiation switch (33) may generate only a vehicle sound indicating that the seat-belt (6) must be fastened.

Figure 1:
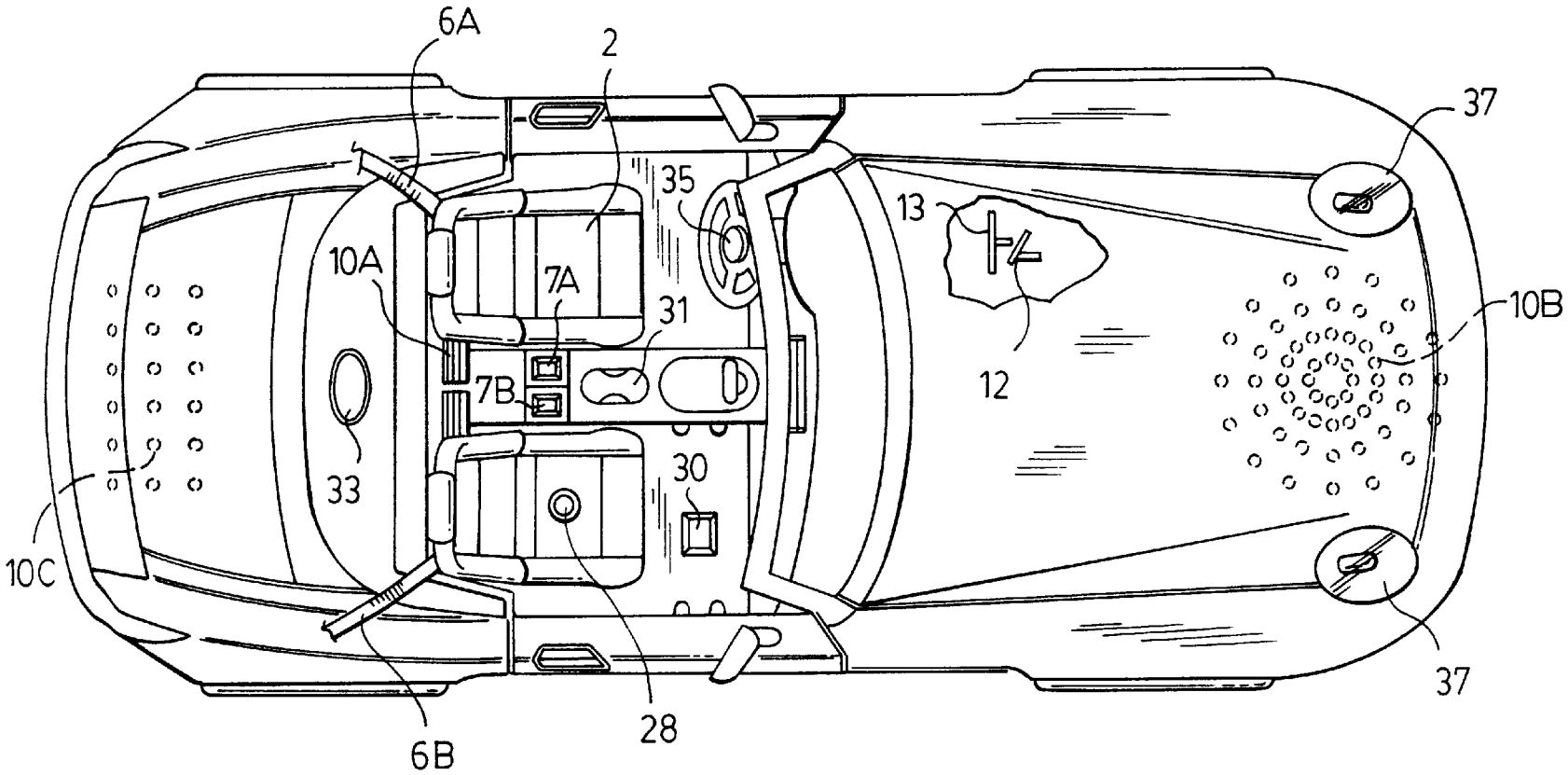
FIG. 1 is a plan view of a toy vehicle.
Figure 2:
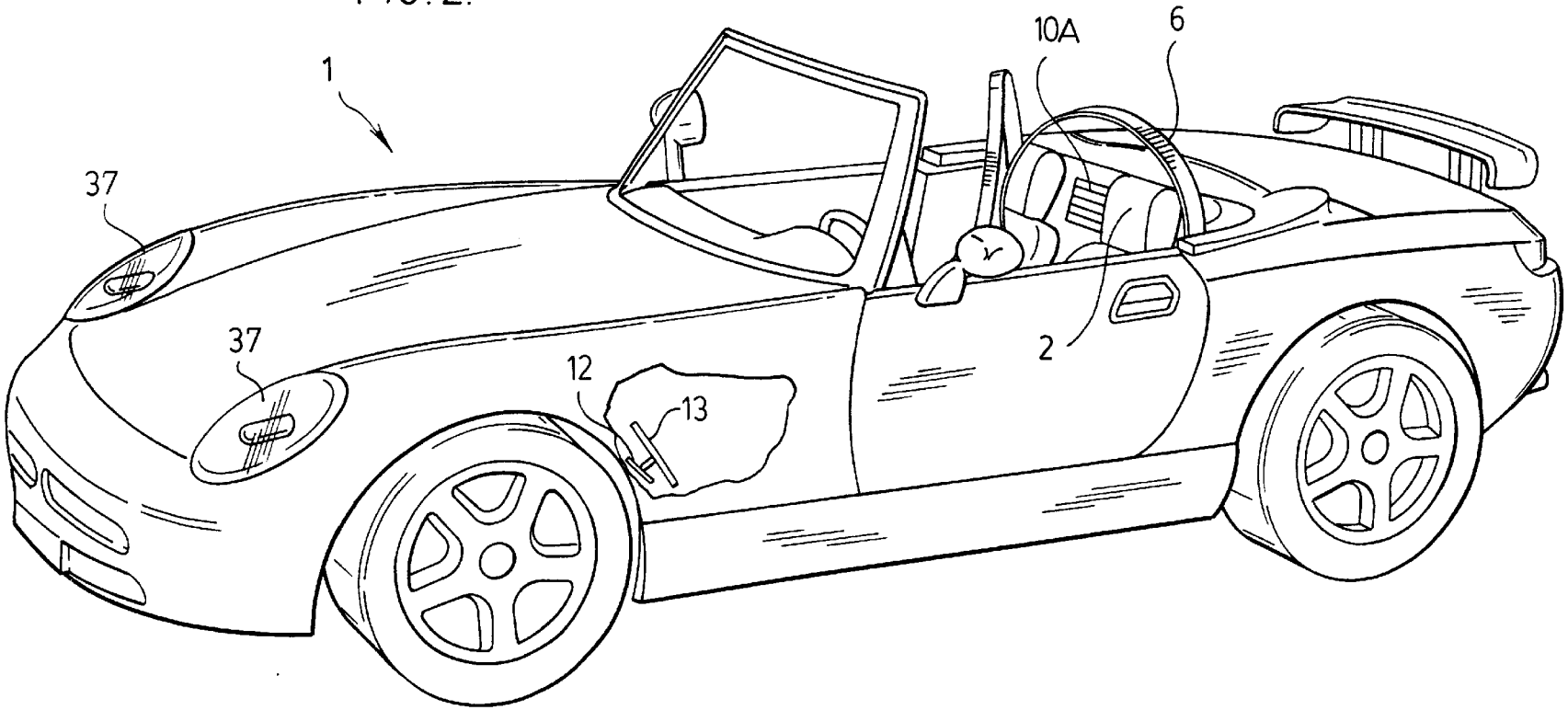
FIG. 2 is a perspective view of a toy vehicle.
Figure 3:
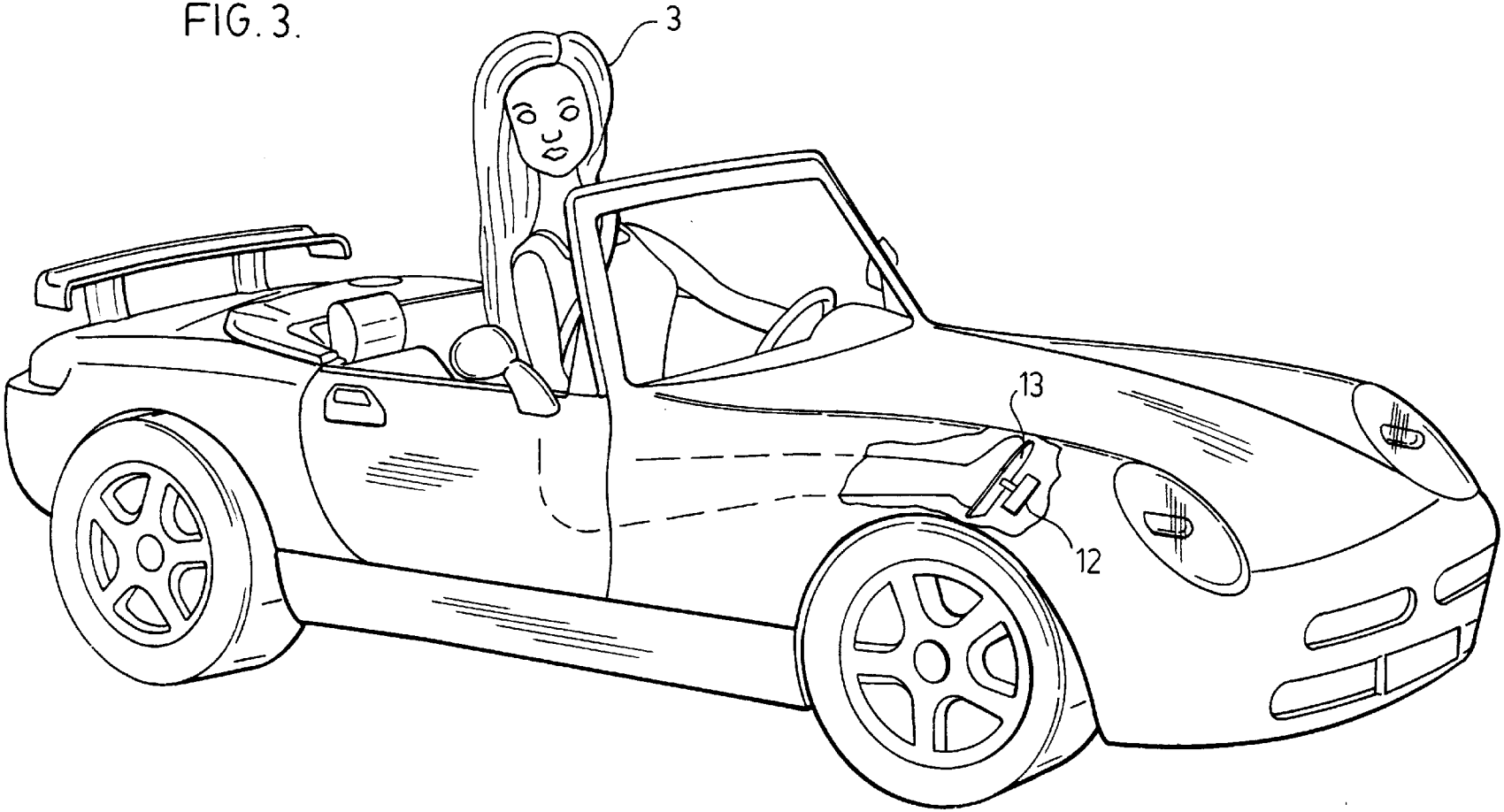
FIG. 3 is a perspective view of a toy vehicle and toy figure combination.
Figure 5:
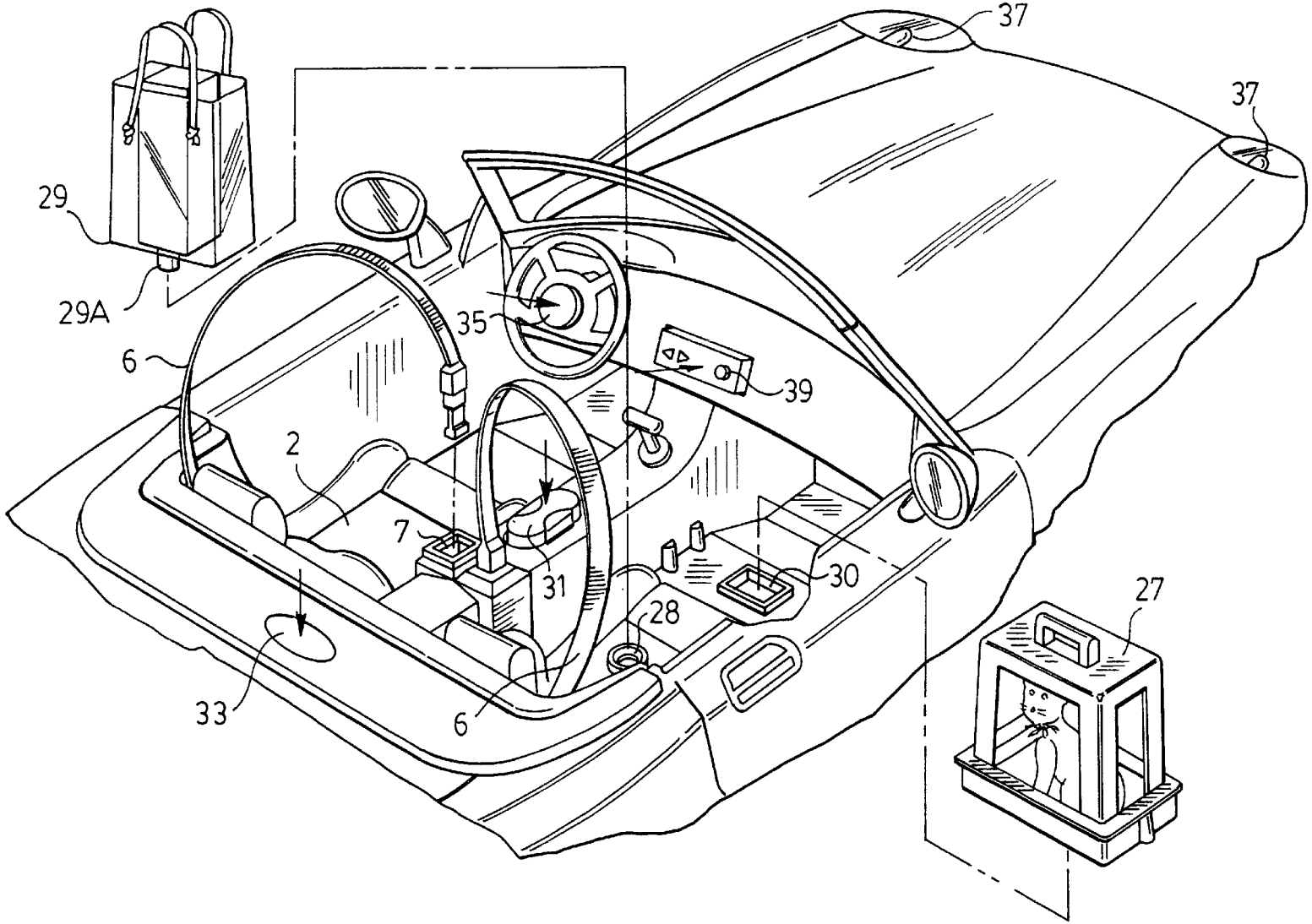
FIG. 5 is a schematic cutaway view of a portion of a vehicle illustrating pushbutton controls, switches and accessories.

A second seat-belt (6B) for a passenger may be provided, however, the placing of the end of seat-belt (6B) into corresponding socket (7B) does not generate any activity in the embodiment of the invention described herein. Normally, no passenger will be present in the passenger seat. Instead, various accessories may be placed in or near the passenger seat. For example, as illustrated in FIGS. 1 and 5, a shopping bag (29) may be provided with a protrusion (29A) adapted to fit into socket (28). When protrusion (29A) is inserted into socket (28), a switch (not shown) is triggered to initiate the generation of sound segments from the action figure appropriate to the placement of the shopping bag (29) in the vehicle. Similarly, an appropriately shaped portion of pet cage (27) can be placed in pet cage socket (30) to trigger a switch (not shown) to generate appropriate sound segments. Indeed, under the control of the integrated circuit, comments appropriate to the placement of both of the accessories (29, 27) can be generated. In other words, the toy figure could comment on the presence of the shopping bag (29) in the vicinity of the pet cage (27).

Other accessories can operate with or without simulated commentary from the toy figure. For example, pressure on horn pushbutton (35) can generate the sound of a horn from either speaker (9A) or (9B), as appropriate, along with the flashing of headlights (37). Alternatively, pressure on horn pushbutton (35) could also initiate a comment from the other speaker, ostensibly from the toy figure, relating to operation of the horn and lights.

Pushbutton (39) may initiate generation of pre-recorded radio programming sounds in a similar fashion. Pushbutton (31) may initiate the placing or receiving of a cell-phone call, along with an appropriate simulated conversation between the toy figure and another person over that cell-phone. In the illustrated embodiment, the toy cell-phone comprises the entire pushbutton (31).

Figure 7:
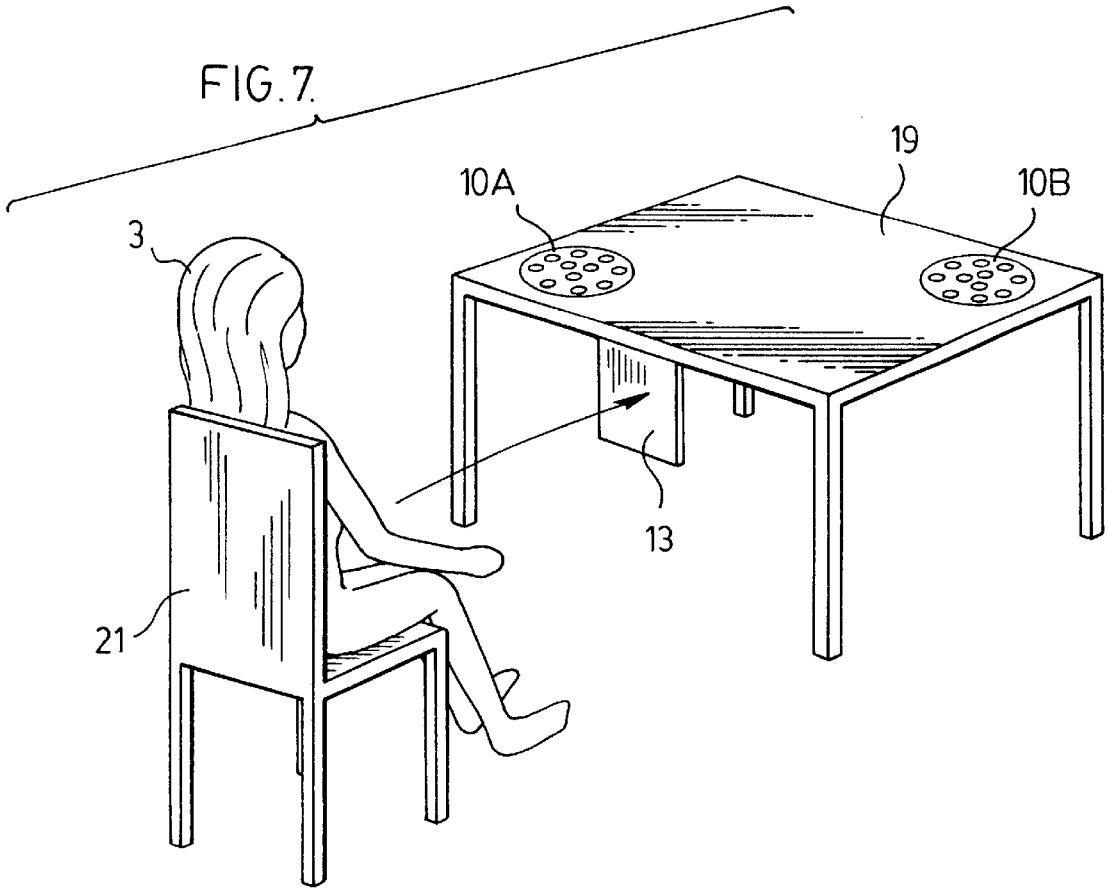
FIG. 7 is a schematic perspective view of a chair, desk and toy figure combination embodiment of the invention.

FIG. 7 illustrates an alternative embodiment of the invention with a table (19) or vanity (not shown) comprising trigger means (13) and speaker openings (10A, 10B). When a chair (21) and a toy figure (3) are pushed under the table (19), trigger means (13) are activated to initiate a series of activities similar to those described in relation to the toy vehicle.

Figure 8:
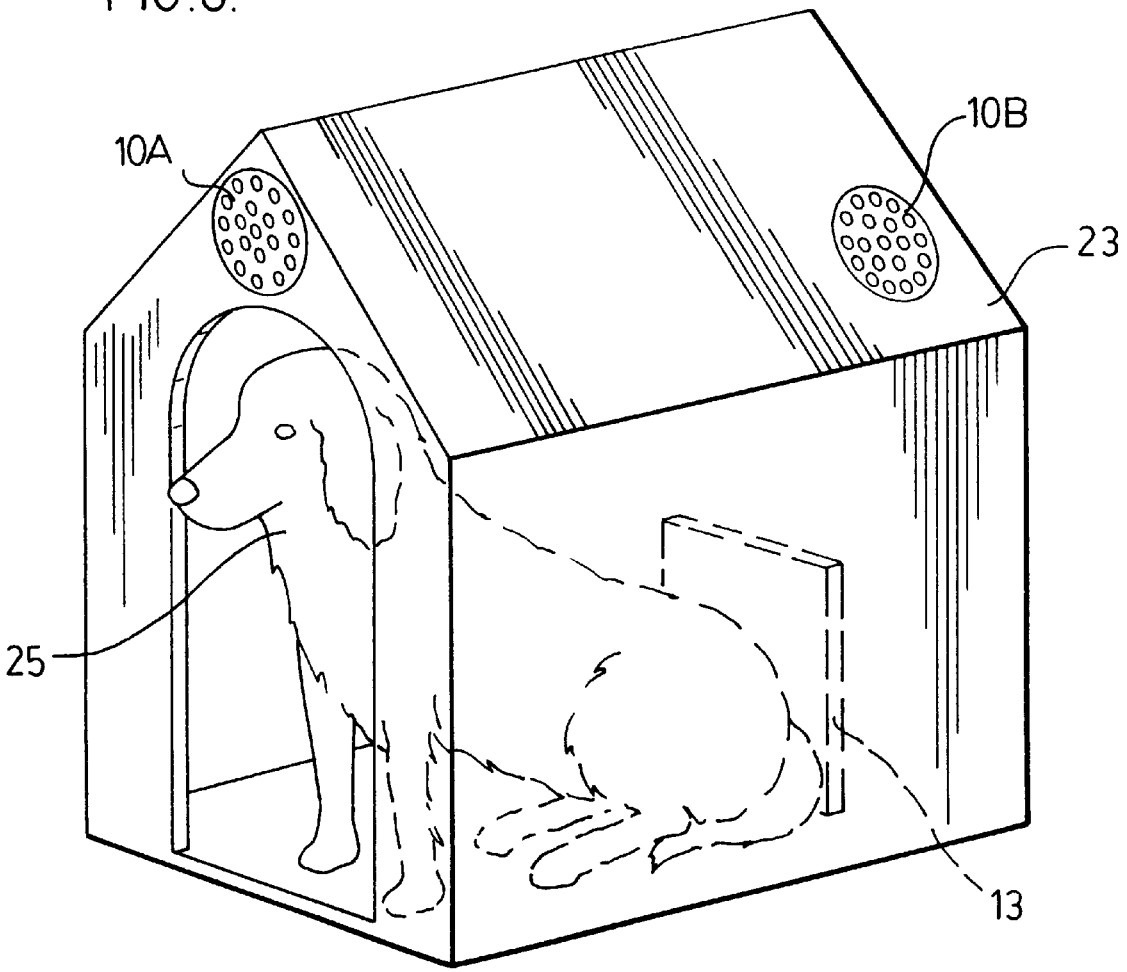
FIG. 8 is a schematic perspective view of a pet house and toy pet combination embodiment of the invention.

Similarly, FIG. 8 illustrates a further alternative embodiment of the invention in which a pet house (23) comprises trigger means (13) and speaker openings (10A, 10B). When a pet toy (25) is placed into contact with trigger means (13), a similar series of activities can be generated.

Although illustrative embodiments of the invention have been described in detail, it will be understood that other variations can be made without departing from the spirit and scope of the invention.

What is claimed is:

1. An electronic toy having a seat for receiving a doll or action figure comprising:

an electrical storage battery comprising a source of electrical power;

an integrated circuit chip programmed with pre-recorded sounds;

first and second audio speakers adapted to reproduce sounds based on signals from the integrated circuit chip;

said first audio speaker being located proximate said seat, and being dedicated to reproducing sounds corresponding to simulated speech of the doll;

said second audio speaker being located remotely from said seat, and being dedicated to reproducing sounds other than simulated speech of the doll;

switch means adapted to open or close an electrical circuit to control the flow of electrical power from the source to the integrated circuit and the audio speakers; and trigger means adapted to activate the switch means;

such that when the toy receives the doll, a portion of the doll contacts the trigger means to close the switch means and initiate production of sounds.

2. The electronic toy of claim 1, further comprising a socket for receiving an accessory to trigger generation of a sound segment appropriate to the accessory.

3. The electronic toy of claim 1, further comprising a pushbutton switch to trigger generation of sound segments.

4. The electronic toy of claim 1, further comprising of plurality of pushbutton switches, each such pushbutton switch adapted to generate sound segments specific to said pushbutton switch.

5. An electronic toy having a seat for receiving a doll or action figure comprising:

an electrical storage battery comprising a source of electrical power;

an integrated circuit chip programmed with pre-recorded sounds;

first and second audio speakers adapted to reproduce sounds based on signals from the integrated circuit chip;

said first audio speaker being located remote from said seat, and being dedicated to reproducing sounds corresponding to simulated speech of the doll;

said second audio speaker being located proximate said seat, and being dedicated to reproducing sounds other than simulated speech of the doll;

switch means adapted to open or close an electrical circuit to control the flow of electrical power from the source to the integrated circuit and the audio speakers; and trigger means adapted to activate the switch means;

such that when the toy receives the doll, a portion of the doll contacts the trigger means to close the switch means and initiate production of sounds.

6. The electronic toy of claim 5, further comprising a socket for receiving an accessory to trigger generation of a sound segment appropriate to the accessory.

7. The electronic toy of claim 5, further comprising a pushbutton switch to trigger generation of sound segments.

8. The electronic toy of claim 5, further comprising of plurality of pushbutton switches, each such pushbutton switch adapted to generate sound segments specific to said pushbutton switch.

* * * * *